US010532904B2

(12) United States Patent
Hachmann et al.

(10) Patent No.: US 10,532,904 B2
(45) Date of Patent: Jan. 14, 2020

(54) WINDING MACHINE FOR WINDING STRIPS OF MATERIAL

(71) Applicant: TRUETZSCHLER GMBH & CO. KG, Moenchengladbach (DE)

(72) Inventors: Andreas Hachmann, Schloss Holte-Stukenbrock (DE); Manfred Penkert, Leopoldshoehe (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 268 days.

(21) Appl. No.: 15/525,299

(22) PCT Filed: Oct. 31, 2015

(86) PCT No.: PCT/EP2015/002188
§ 371 (c)(1),
(2) Date: May 9, 2017

(87) PCT Pub. No.: WO2016/074772
PCT Pub. Date: Mar. 19, 2016

(65) Prior Publication Data

US 2018/0016108 A1 Jan. 18, 2018

(30) Foreign Application Priority Data

Nov. 14, 2014 (DE) ..... 10 2014 116 653

(51) Int. Cl.
*B65H 18/16* (2006.01)
*B65H 19/22* (2006.01)
(Continued)

(52) U.S. Cl.
CPC ..... *B65H 19/2292* (2013.01); *B65H 18/16* (2013.01); *B65H 18/26* (2013.01);
(Continued)

(58) Field of Classification Search
CPC .. B65H 19/28; B65H 19/265; B65H 19/2207; B65H 19/2292; B65H 18/16; B65H 18/26
See application file for complete search history.

(56) References Cited

U.S. PATENT DOCUMENTS 2,586,833 A 2/1952 Kohler et al.
3,592,403 A 7/1971 Schmitt et al.
(Continued)

FOREIGN PATENT DOCUMENTS

EP 1216943 A2 6/2002
JP S58188252 A 11/1983

OTHER PUBLICATIONS

International Search Report for PCT/EP2015/002188, dated Feb. 8, 2016, and English Translation thereof.
Written Opinion for PCT/EP2015/002188, dated Feb. 8, 2016.

*Primary Examiner* — Sang K Kim
(74) *Attorney, Agent, or Firm* — FisherBroyles, LLP; Robert Kinberg

(57) ABSTRACT

A winding station and a method for winding material webs, in particular foils or films, wherein during a continuous movement of the material web, a removal fork pivots the nearly full winding sleeve from a front position to a rear removal position while a new winding sleeve is moved to the winding position. The winding station is provided with a device to wind the material web automatically onto a new winding sleeve following the separation of the completed winding.

4 Claims, 4 Drawing Sheets

(51) Int. Cl.
*B65H 18/26* (2006.01)
*B65H 19/26* (2006.01)

(52) U.S. Cl.
CPC ..... *B65H 19/265* (2013.01); *B65H 2701/173* (2013.01); *B65H 2701/1842* (2013.01)

(56) References Cited

U.S. PATENT DOCUMENTS

| | | | | |
|---|---|---|---|---|
| 3,827,647 | A * | 8/1974 | Jores ..... | B65H 19/2207<br>242/527.6 |
| 6,273,356 | B1 | 8/2001 | Burton et al. | |
| 6,644,586 | B2 | 11/2003 | Birke et al. | |
| 2008/0223975 | A1 * | 9/2008 | Planeta ..... | B65H 19/2253<br>242/525.2 |
| 2013/0200200 | A1 | 8/2013 | Oravits et al. | |

* cited by examiner

WINDING MACHINE FOR WINDING STRIPS OF MATERIAL

CROSS-REFERENCE TO RELATED APPLICATIONS

This application is a U.S. National Stage of International Patent Application No. PCT/EP2015/002188 filed Oct. 31, 2015, designating the United States and claiming benefit of German Patent Application No. 10 2014 116 653.1 filed Nov. 14, 2014.

BACKGROUND OF THE INVENTION

The invention relates to a machine for winding material webs, in particular foils or films, wherein during a continuous operation of the material web, a removal fork pivots the nearly full winding from a front position to a rear removal position while a new winding sleeve is moved to the winding position, wherein following the separating of the full winding sleeve, the winding station comprises a device to automatically wind the material web onto the new winding sleeve.

With known turret winders, two or more winding stations are provided on a two-armed pivot arm or a large rotating disc, wherein the material is initially wound in a first winding station with the aid of a central, driven winding roll. A non-driven contact roll fits from the outside against the increasing winding and can be moved relative to the winding roll and the continuously increasing material wound around the roll. The turret winders comprise a special cutting device which essentially consists of a blade that can move forward suddenly to cut the foil at a right angle, as well as guide rolls both of which are positioned on a pivot arm. During the replacement phase, the nearly full winding roll or lap roll is pivoted during the continuous operation from a front position to a rear position for the removal, wherein a new winding station is then moved to a corresponding front winding position and a new winding roll with non-prepared sleeve is made available. In the process, the described cutting device is also pivoted toward the foil web. The rolls around which the material is wrapped subsequently direct the course of the foil web in such a way that it can wrap itself for the most part around the winding sleeve on the new winding axis. The cutting blade at the same time cuts suddenly through the foil web, so that the new winding can form continuously. Turret winders have the advantage of allowing a right-angle foil cut, so that practically no waste material results. The central winding resulting from the central drive of the winding roll is an advantage for some foils and also permits good web tension control when using a corresponding measuring roll, such as is required for numerous quality foils for winding. One considerable disadvantage of the known turret winders is the involved process for changing the winding since the foil or film must be fitted against the winding sleeve and secured with glue points.

SUMMARY OF THE INVENTION

The object of the present invention is to create a winding machine of the above-described type which allows a faster change of the full winding.

The above and other objects are accomplished according to one aspect of the invention wherein there is provided an embodiment of a winding station for the winding of material webs, including foils or films, the winding station comprising: a removal fork that pivots, during a continuous operation of the winding station, a nearly full winding from a front position to a rear removal position while a new winding sleeve is moved to the winding position; and a device to automatically wind the material web onto a new winding sleeve following a separation of the completed winding.

According to an embodiment, the winding station is provided with a device which can be used to automatically wind the material web onto a new winding sleeve once the full winding has been separated.

According to an embodiment, the device takes the form of three wedge gaps that work together with the winding sleeve. The material web is thus guided completely around the new winding sleeve, so that an attachment with glue points is not necessary. A fully automatic change of the full winding is thus possible without stopping the operation. The wedge gaps ensure an automatic circulating of the material web around the winding sleeve since the material wedge or strip is pulled into the respective gap and, in part, is guided around the winding sleeve until the following wedge gaps is reached.

The device to form a wedge gap can be a feeder system in the form of rolls, belts or guides. Once the material web is guided around the winding sleeve, the rolls, belts or guides simultaneously function as contact locations for pressing the material web against the winding sleeve and guiding it.

According to an embodiment, the device comprises a first and a second roll which can be moved toward or away from the winding sleeve. The embodiment using rolls has the advantage that these can be operated easily and with little expenditure at a circumferential speed that is the same as the speed for the material web. Suitable for this are direct or indirect drives, for example electric motors or belt drives.

To generate the wedge gaps if possible only for the start of the winding operation, at least one roll can be arranged on a carriage that moves along a guide either toward or away from the winding sleeve. For a winding with increasing diameter, the guidance and/or the course of the material web can thus be optimized so that no additional friction occurs through the contact roll. The tension of the material web can thus be kept more constant.

A pressing roll which can be moved via a pivot arm functions to form the third wedge gap.

According to another aspect of the invention there is provided an embodiment for a method for winding material webs, including foils or films, comprising: during a continuous movement of the material web, a removal fork pivots the nearly full winding sleeve from a front winding position to a rear removal position while a new winding sleeve is moved to the front winding position; following a separation of the material web on a full winding sleeve, the material web is switched automatically from the full winding sleeve to a new winding sleeve for a new winding operation; and guiding the material web by at least three contact locations around the winding sleeve.

Thus, according to this embodiment, a method for winding material webs the material web can be wound automatically onto a new sleeve once it is separated from the full winding roll, wherein the material web at least at times is guided by at least three contact locations around the winding sleeve. The contact locations can be generated through rolls, belts or guides.

According to a further embodiment, the first contact location is formed with a roll that is being driven underneath the winding sleeve.

The second contact location may be formed with a contact roll which can be pivoted or driven.

The third contact location may be formed with the aid of at least one pressing roll which is moved against the winding sleeve during the separation of the material web.

BRIEF DESCRIPTION OF THE DRAWINGS

The invention is explained in further detail with the aid of the enclosed drawings, in which.

DETAILED DESCRIPTION OF THE INVENTION

Figure 1:
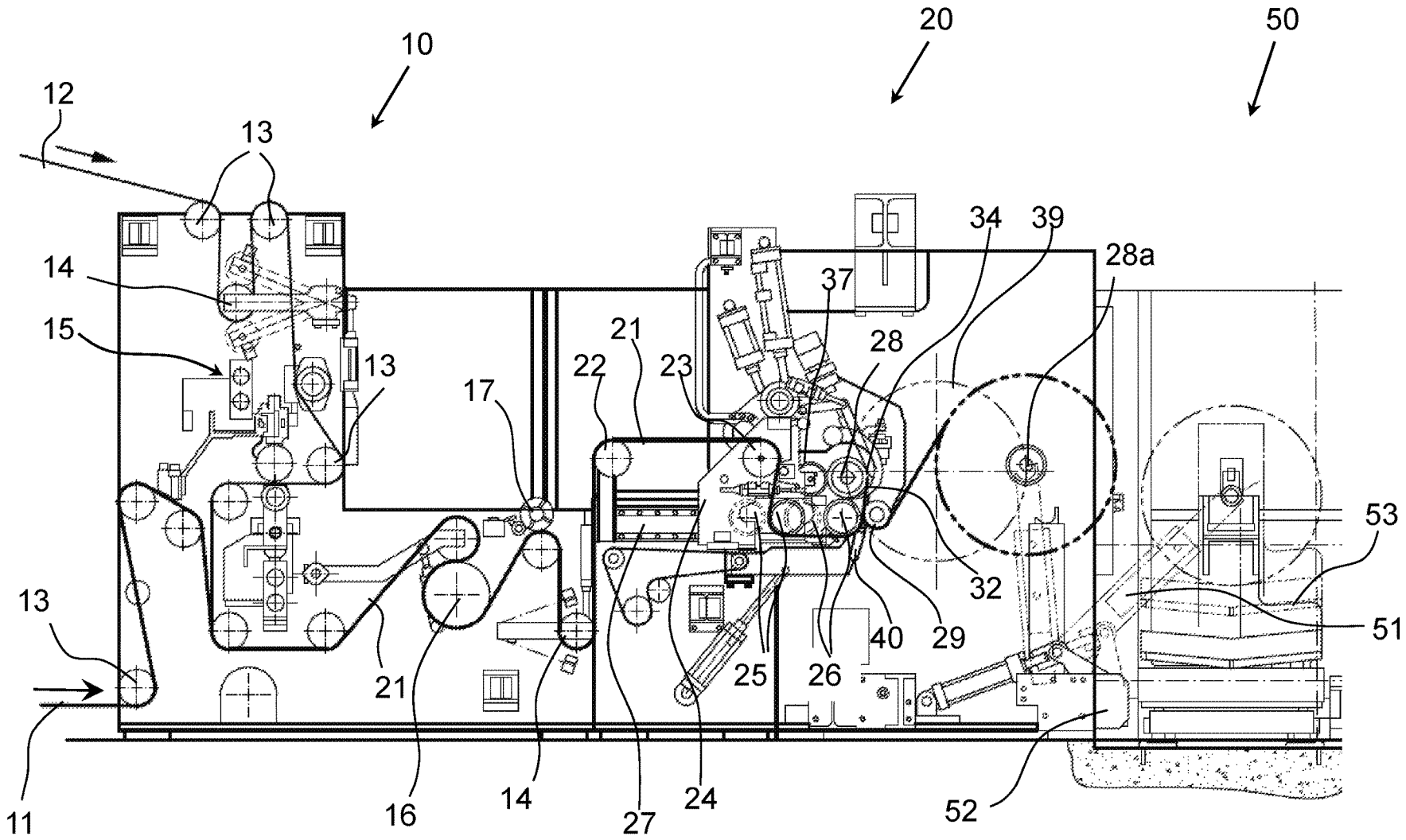
FIG. 1 is a total arrangement for a winding machine.

According to FIG. 1, the total arrangement of the winding machine includes an intake station 10 for the intake of one or several material webs 11, 12, positioned one above the other, from which they are transported further as a single material web 21 to a following winding station 20 to be wound around a sleeve 28. Following the winding operation, a full winding is transferred from the winding station 20 to a transporting station 50.

For this exemplary embodiment, a first material web 11 is guided via several deflection rolls 13 into the region of the winding station 20. On the way there, the tension of the material web 11 can be measured and adapted to a specified value via force-driven pendulum rolls 14. The area of the intake station 10 can furthermore contain various devices 15 for inspecting the material web, for example to detect defects or deviations in the tension. A second material web 12 can be fed from above into the intake station 10 and can be combined with the first material web 11. For this, the second material web 12 comes to rest on the first material web 11, wherein the superimposed material webs are combined to form a joint material web 21 with the aid of a set of pressing rolls 16. A roll arranged just before the winding station 20 or a pair of rolls 17 can be embodied for cutting the material web 21 into strips, which are then wound up simultaneously but side by side in the following winding machine. The material webs 11, 12 entering the intake station 10 can be composed of natural or synthetic materials, for example a cotton fleece or a nonwoven material. Alternatively, the material webs 11, 12 can also consist of foils or films, for example of plastic or aluminum.

The winding station 20 comprises at least one left and one right frame wall 20*a*, 20*b* between which the material web 21 enters and is wound around a winding sleeve 28 which is driven and is positioned inside a receptacle 36. All other components are arranged locally fixed or pivoting or displaceable between the frame walls 20*a*, 20*b*.

Figure 3:
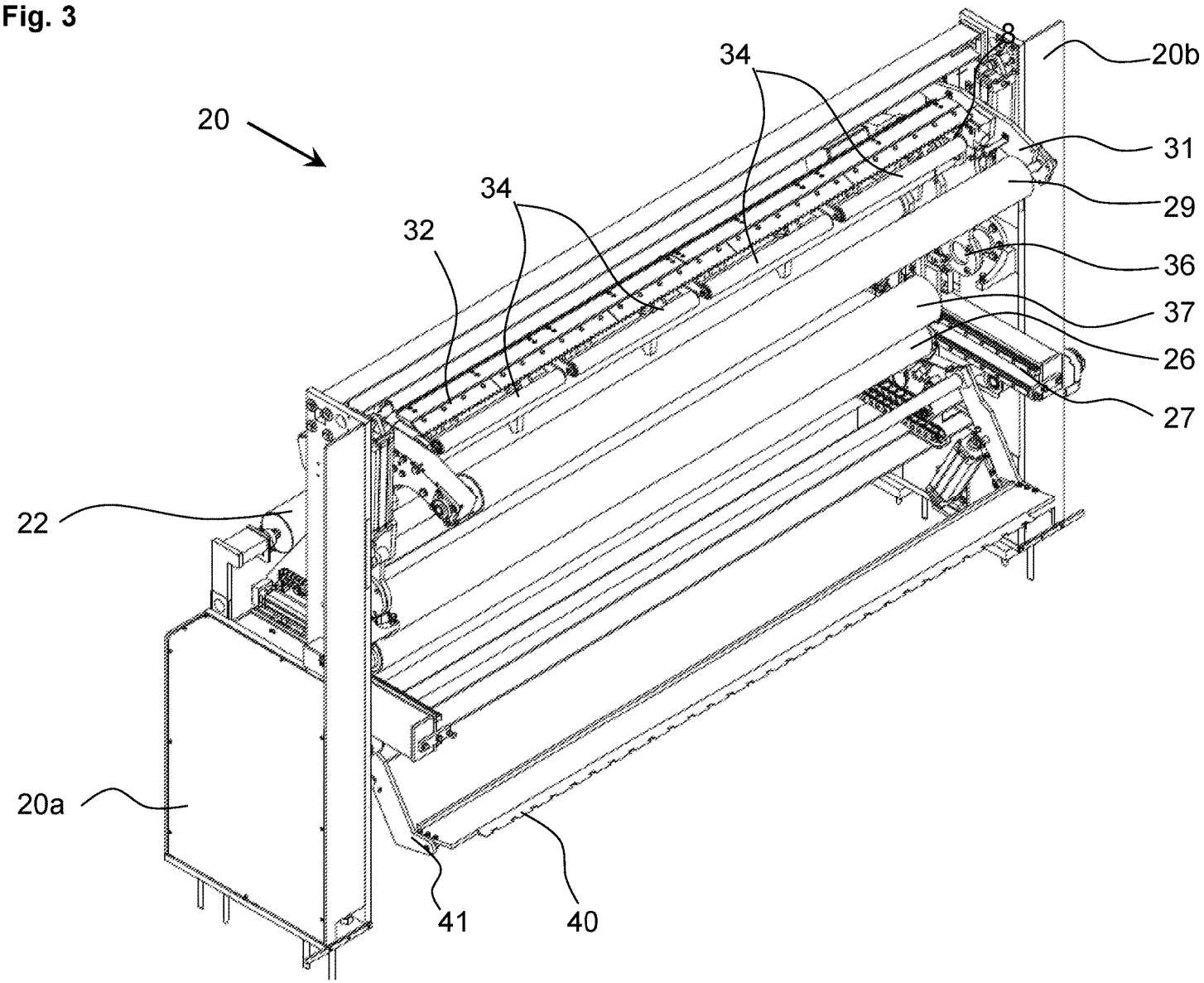
FIG. 3 is a perspective representation of a winding machine.

FIG. 1 shows the empty winding sleeve 28 and the full winding sleeve 28*a* during the operation. In FIG. 3, the winding station 20 is shown without the winding sleeve 28.

Figure 2:
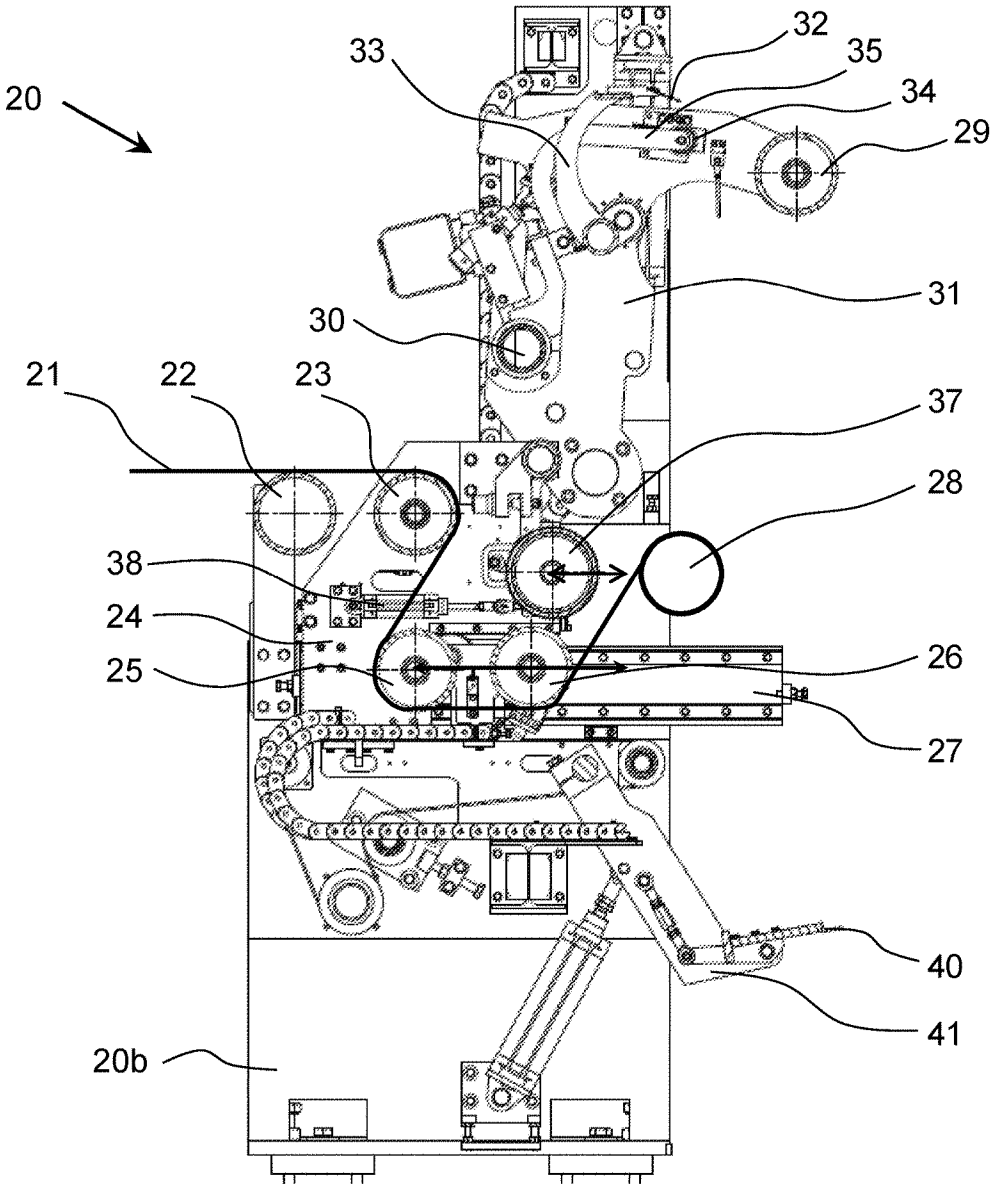
FIG. 2 is a sectional view from the side of a winding machine.

According to FIG. 2, the material web 21 enters via a first roll 22 and subsequently via a second roll 23 into the winding station 20, wherein the roll 23 deflects the material web by approximately 90° in vertical direction downward to an additional roll 25. The roll 25 also deflects the material web by approximately 90° in horizontal direction toward a following roll 26, which then also deflects the material web by approximately 90° upward to the winding sleeve 28. In the process, the material web 21 is wound around the sleeve 28 from above, meaning the top side of the material web 21 entering the winding station is located on the outside of the winding during the winding operation.

The rolls 23, 25, 26 and 37 are arranged on a carriage 24 which can move along a guide 27. The guide 27 is arranged on the left and the right frame wall 20*a*, 20*b*. For this, the rolls 25 and 26 are arranged spaced-apart in a horizontal plane located approximately at the height of the guide 27. The rolls 23 and 37 are also arranged spaced-apart on the carriage 24, but are located vertically above the rolls 25 and 26. The contact roll 37 on the carriage 24 only can be adjusted separately via the cylinder 38 with respect to the distance to the winding sleeve 28, wherein the contact roll 37 is arranged pivoting or traversing on the carriage 24. The rolls 23, 25, 26 and 37 can thus be moved on the carriage 24, jointly back and forth to the winding sleeve. In addition, the contact roll 37 is arranged traversing on the carriage 24, relative to the other rolls 23, 25, 26.

Figure 2B:
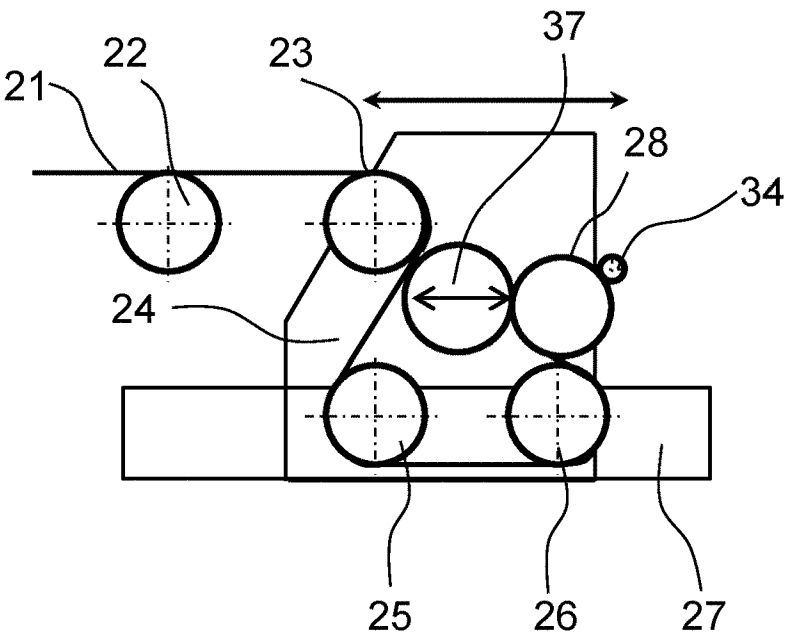
FIGS. 2*a*, 2*b* is a schematic representation of the winding operation.
Figure 2A:
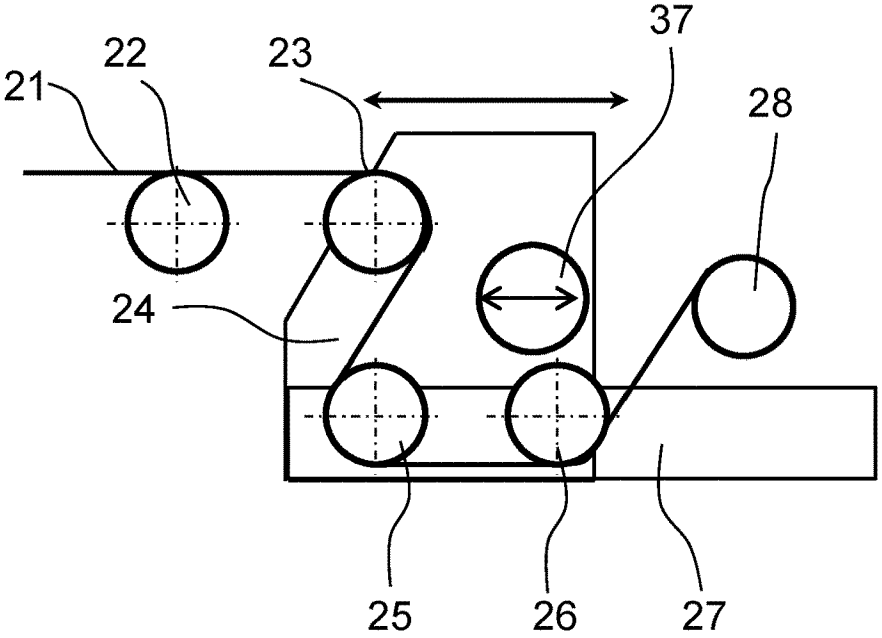

In FIGS. 2*a* and 2*b*, the carriage 24 with the rolls 25 and 26 has been moved to the left position, wherein the contact roll 37 was also moved to a position in which the contact roll 37 does not come in contact with the material web 21. For this embodiment, the winding is created from above since the contact roll 37 (FIGS. 1 and 2*b*) can be moved close enough to the winding sleeve 28 so that a gap for wedging in the material web forms between the contact roll 37 and the winding sleeve 28, by means of which the material web 21 can be wound clockwise around the winding sleeve 28, without manual support. As a result of the generated wedge gap, the material web 21 is pulled into the gap and guided around the winding sleeve 28. Following the first rotation of the material web 21 around the winding sleeve 28, the roll 26, the contact roll 37 and the pressing roll 34 generate at least at times a contact location which is then removed when the winding increases by removing and/or pivoting away the rolls/cylinders.

For the start of the winding reference is made to FIGS. 1 and 2*b*. The material web 21 also enters via a first roll 22 and subsequently over a second roll 23 into the winding station 20, wherein the roll 23 deflects the material web by about 90° vertically downward to another roll 25. The roll 25 also deflects the material web 21 by approximately 90° horizontally to a following roll 26 which then guides the material web 21 by more than 90° upward to a winding sleeve 28. In FIG. 1 and the enlarged view shown in FIG. 2*b*, the carriage 24 with the rolls 25 and 26 is moved to a position on the right, so that the roll 26 is arranged nearly perpendicular below the winding sleeve 28 and together with this sleeve forms a first wedge gap through which the material web is guided clockwise from below to and/or around the winding sleeve. The contact roll 37 is moved with the aid of the cylinder 38 to a position in which it nearly touches the winding sleeve 28 and together with this sleeve forms a second gap, so that the material web 21 can adhere to the winding sleeve 28 without manual support or glue points and can be wound around it.

Following several complete rotations of the winding sleeve 28, the contact roll 37 is first moved away from the winding sleeve 28 and the complete carriage 24 is then moved to the left, as shown in the FIGS. 2*a* and 2*b*.

Above the carriage 24 and above the winding sleeve 28, a pivot arm 31 is arranged on each side of the frame wall 20*a*, 20*b*, which arm can be pivoted around the rotational point 30 and is provided with a rotating deflection roll 29 at its outer end. A blade 32 that extends over the total width of the winding sleeve 28 and/or the working width of the winding machine is furthermore arranged via swiveling levers 33 on each of the pivot arms 31. In the region of the blade or blades 32, one or several pressing rolls 34 are arranged via separate pivot arms 35 which also extend individually or together, essentially over the length of the winding sleeve 28.

Below the guide 27 a counter blade 40 is arranged on both sides, on respectively one lever 41 which operates jointly with the blade 32 for cutting the material web 21 and prevents the material web from being pushed away during the cutting.

With reference to FIG. 1, the replacement of the nearly full winding takes place as follows:

While the material web continues to move, the nearly full winding sleeve 28*a* is swiveled from the front position with the aid of one or several removal forks 51 around the pivoting circle 39 to a rear removal position and into the transporting station 50, wherein simultaneously a new winding sleeve 28 is moved to the new winding position above the roll 26. The carriage 24 with the rolls 23, 25, 26 and 37 traverses along the guide 27 to a position on the right, so that the roll 26 forms a first wedge gap together with the winding sleeve 28. The contact roll 37 also traverses on the carriage 24 to a right position, so that a second gap forms between the contact roll 37 and the winding sleeve 28. The pivot arms 31 with the deflection roll 29 then pivot around the pivoting point 30, thereby pushing down the material web 21 until it reaches the level of the roll 26 where it is deflected by the deflection roll 29. In the process, the material web 21 wraps itself by more than 270° around the winding sleeve 28, which is sufficient for the start of the new winding. At the same time the pivot arms 35 with the pressing roll or rolls 34 also pivot toward the material web 21. The pressing rolls 34 then provide a course for the material web 21 which allows it to wrap itself far around the winding sleeve 28 on the new winding axis. At the same time, the blade 32 suddenly cuts through the material web 21 at a right angle to the winding direction, so that the material can wrap itself continuously around the winding sleeve 28 to form a new winding. Since the pressing rolls 34 press the start of the material against the winding sleeve 28 (FIG. 2*b*), the start of the winding operation around the winding sleeve 28 is guided by the first wedge gap formed between the roll 26 and the winding sleeve 28 and subsequently by the second gap formed between the contact roll 37 and the winding sleeve 28 so as to wind around the winding sleeve 28, thus ensuring an automatic start of the winding simultaneously with the cutting of the material web 21 without requiring a manual intervention such as affixing glue points.

Simultaneously with the blade 32, the counter blade 40 enters the region of the material web 21 and functions as a type of cutting support for the blade 32.

Once the material web 21 is cut, the full winding on the winding sleeve 28*a* is pivoted with the aid of the removal fork or forks 51 around the rotational point 52 to the transporting device 50 and is deposited on a table 53 which can be driven itself or remotely and deposits the winding for the further processing.

With increasing size of the new winding, the deflection roll 29 moves back via the pivot arms 31 into the upper starting position. The contact roll 37 traverses along the arrow back to the left position, and the carriage 24 with the rolls 23, 25, 26 and 37 moves along the arrow to the left, to make room for the winding that increases in size.

The winding sleeve 28 and the deflection roll 29 are advantageously driven directly or indirectly, for example via a servomotor or a belt drive.

The deflection rolls 13, the rolls 22, 23, 25, 26, 37 and the pressing rolls 34 can be embodied as rotating, non-driven rolls and/or cylinders, or can be driven directly or indirectly, depending on their function.

For the exemplary embodiment, the pivot arms 31, 35 and the levers 41 are operated with the aid of pneumatic or hydraulic cylinders, wherein the use of a motorized drive is also conceivable.

It will be understood that the above description of the present invention is susceptible to various modifications, changes and adaptations, and that the same are intended to be comprehended within the meaning and range of equivalents of the appended claims.

The invention claimed is:

1. A winding station for the winding of material webs, including foils or films, the winding station comprising:

a removal fork that pivots, during a continuous operation of the winding station, a nearly full winding sleeve from a front position to a rear removal position while a new winding sleeve is moved to the front winding position; and a device to automatically wind the material web onto the new winding sleeve following a separation of a completed winding of the winding sleeve, wherein the device includes means for forming three wedge gaps together with the new winding sleeve, wherein the means includes: first and second rolls that are movable toward and away from the new winding sleeve to form the first and second wedge gaps with the new winding sleeve; a guide and a carriage movable along the guide toward the new winding sleeve and away from the new winding sleeve, the first roll being arranged locally fixed on the carriage and the second roll being arranged traversing or pivoting on the carriage; a pivot arm and a pressing roll mounted on the pivot arm and being movable by the pivot arm to form the third wedge gap.

2. The winding station according to claim 1, wherein the device further includes two spaced-apart rolls arranged spaced-apart on the carriage.

3. The winding station according to claim 1, wherein the first roll is movable underneath the winding sleeve to form the first wedge gap.

4. The winding station according to claim 1, wherein the carriage is movable into a winding position in which the first and second rolls form the first and second wedge gaps with the new winding sleeve and wherein after winding begins on the new winding sleeve the carriage is movable back into an initial position in which at least the second roll has no contact with the material web.

* * * * *